US009626892B2

(12) United States Patent
Wu

(10) Patent No.: US 9,626,892 B2
(45) Date of Patent: Apr. 18, 2017

(54) OPTIMIZATION METHOD AND SYSTEM OF REAL-TIME LCD WHITE BALANCE SELECTION

(71) Applicant: FocalTech Systems Co., Ltd., Hsinchu (TW)

(72) Inventor: Hung-Chu Wu, Hsinchu (TW)

(73) Assignee: FOCALTECH SYSTEMS CO., LTD., Hsinchu (TW)

( * ) Notice: Subject to any disclaimer, the term of this patent is extended or adjusted under 35 U.S.C. 154(b) by 0 days.

(21) Appl. No.: 14/934,230

(22) Filed: Nov. 6, 2015

(65) Prior Publication Data

US 2016/0180759 A1 Jun. 23, 2016

(30) Foreign Application Priority Data

Dec. 23, 2014 (TW) ..... 103145017 A

(51) Int. Cl.

*G09G 5/02* (2006.01)
*G09G 3/20* (2006.01)
*G09G 3/36* (2006.01)

(52) U.S. Cl.

CPC ..... *G09G 3/2003* (2013.01); *G09G 3/36* (2013.01); *G09G 2320/0666* (2013.01)

(58) Field of Classification Search

CPC ..... G09G 5/02; G09G 3/2003; G09G 2320/0666; G09G 2340/06; G09G 2340/0626; G06T 3/4007
USPC ..... 345/581, 600, 604, 606
See application file for complete search history.

(56) References Cited

U.S. PATENT DOCUMENTS

2009/0021647 A1* 1/2009 Choi ..... H04N 9/73 348/655
2011/0025885 A1* 2/2011 Minami ..... H04N 5/772 348/231.3
2013/0063474 A1* 3/2013 Chen ..... G09G 3/3611 345/604
2013/0128073 A1* 5/2013 Seok ..... H04N 9/735 348/223.1
2013/0322745 A1* 12/2013 Lim ..... H04N 9/73 382/162
2014/0218540 A1* 8/2014 Geiss ..... H04N 17/002 348/181

* cited by examiner

*Primary Examiner* — Xiao Wu
*Assistant Examiner* — Sarah Lhymn
(74) *Attorney, Agent, or Firm* — Bacon & Thomas, PLLC

(57) ABSTRACT

An optimization system of real-time LCD white balance selection includes an RGB to YUV conversion unit, a white balance adjustment unit, and a YUV to RGB conversion unit. The RGB to YUV conversion unit receives an image signal and converts the image signal from RGB domain to YUV domain to generate a first YUV image signal. The white balance adjustment unit is connected to the RGB to YUV conversion unit for performing a white balance adjustment on the first YUV image signal and thus generating a second YUV image signal. The YUV to RGB conversion unit is connected to the white balance adjustment unit for converting the second YUV image signal from YUV domain to RGB domain.

6 Claims, 5 Drawing Sheets

OPTIMIZATION METHOD AND SYSTEM OF REAL-TIME LCD WHITE BALANCE SELECTION

FIELD OF THE INVENTION

The present invention relates to the technical field of display panels, and more particularly, to an optimization method and system of real-time LCD white balance selection.

DESCRIPTION OF RELATED ART

In recent years, as the development of broadcasting and communication technologies continue to advance, new display devices continue to emerge. Among them, LCD display technology is the most significant. Due to its excellent features of low voltage and low power consumption, LCD can be integrated directly with a wide variety of integrated circuits (IC) to develop a series of products with display function.

Display devices, such as display monitors, screens of cellphones, display screens of digital cameras, need to have a white balance adjustment function. The result of the white balance adjustment may directly influence the quality of a display frame. Conventionally, the white balance adjustment is performed manually, and thus, is time-wasting and very difficult to perform. Currently, a personal computer (PC) is used to perform the white balance adjustment on a production line. However, PC is relatively large in size, hard to move around, and expensive for establishment, and hence, is not suitable for production line.

The white balance adjustment is performed by configuring the gains and offsets at the front and rear ends of graphic processing IC to influence the color output of an LCD screen. The white balance adjustment is inherently a color temperature adjustment, which allows the output of the LCD screen to achieve a standard visual effect. The color temperature is a simple way to describe the color spectrum characteristics of light source. Low color temperature indicates warm color light (toward yellow/red) and high color temperature indicates cold color light (toward blue). The standard unit of the color temperature is Kelvin, which is abbreviated as k.

During the white balance adjustment, red, green, and blue (RGB) colors of the LCD screen are adjusted to a desired color temperature value. The RGB colors of the LCD screen are also adjusted to meet the parameter requirement of the LCD screen. The RGB data is then stored in a nonvolatile storage (such as EEPROM) for further adjustment. However, since one color temperature requires one set of RGB data; therefore, the capacity of the storage device will need to be relatively large.

The U.S. Pat. No. 8,531,381 granted to Feng for "Methods and systems for LED backlight white balance" determines new RGB driving values by means of measurement and a correction matrix computation. However, such methods and systems are not suitable for real-time white balance selection. This is because each output of the RGB driving values for a new set of white points must be produced by executing repetitive white balance measurement and computation. The US patent application publication number 20120188265 entitled "Image Display Device and Method for Adjusting Correction Data in Look-Up Table" discloses a simplified white balance adjustment method. This method adjusts the white balance of various gray scales based on a white balance adjustment value GainH suitable for high gray scales and a white balance adjustment value GainL suitable for low gray scales. However, such the method only aims to provide one adjusted set of white balance settings for all screens. It is unable to be applied in real-time white balance selection.

Accordingly, an improved white balance adjustment method and system to mitigate and/or obviate the aforementioned problems is needed.

SUMMARY OF THE INVENTION

One aspect of the present invention is to provide an optimization method and system of real-time LCD white balance selection. A white balance adjustment procedure is performed in a YUV domain, wherein the luminance signal (Y) remains unchanged while the chrominance signal (U/V) is adjusted. Thereby, the luminance of most gray scales is maintained with no loss during a white point coordinate adjustment.

According to one aspect of the present invention, an optimization system of real-time LCD white balance selection is provided, which includes an RGB to YUV conversion unit, a white balance adjustment unit, and a YUV to RGB conversion unit. The RGB to YUV conversion unit receives an image signal and converts the image signal from an RGB domain to a YUV domain to generate a first YUV image signal. The white balance adjustment unit is connected to the RGB to YUV conversion unit for performing a white balance adjustment on the first YUV image signal to generate a second YUV image signal. The YUV to RGB conversion unit converts the second YUV image signal from the YUV domain to the RGB domain.

According to another aspect of the present invention, an optimization method of real-time LCD white balance selection is provided, which is used in an image display device. The optimization method includes: (A) converting an image signal from an RGB domain to a YUV domain for generating a first YUV image signal; (B) performing a white balance adjustment on the first YUV image signal for generating a second YUV image signal; and (C) converting the second YUV image signal from the YUV domain to the RGB domain.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
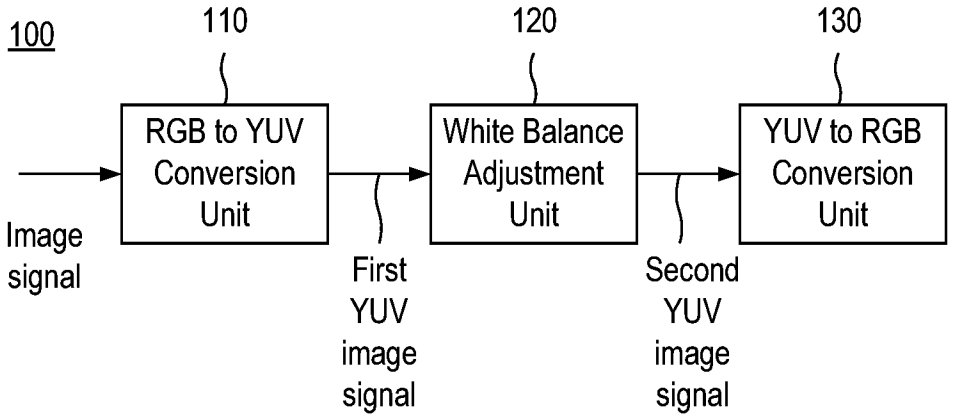
FIG. 1 is a block diagram of an optimization system of real-time LCD white balance selection according to the present invention.

FIG. 1 is a block diagram of an optimization system 100 of real-time LCD white balance selection according to the present invention. The optimization system 100 includes an RGB to YUV conversion unit 110, a white balance adjustment unit 120, and a YUV to RGB conversion unit 130.

The RGB to YUV conversion unit 110 receives an image signal and converts the image signal from an RGB domain to a YUV domain to generate a first YUV image signal. In comparison with the prior art that performs white balance adjustment in the RGB domain, the present invention performs the white balance adjustment in the YUV domain, and thus, the image signal has to be converted to the YUV domain first.

The white balance adjustment unit 120 is connected to the RGB to YUV conversion unit 110 for performing a white balance adjustment on the first YUV image signal to generate a second YUV image signal.

The YUV to RGB conversion unit 130 is connected to the white balance adjustment unit 120 for converting the second YUV image signal from the YUV domain to the RGB domain in order to drive a screen.

Figure 2:
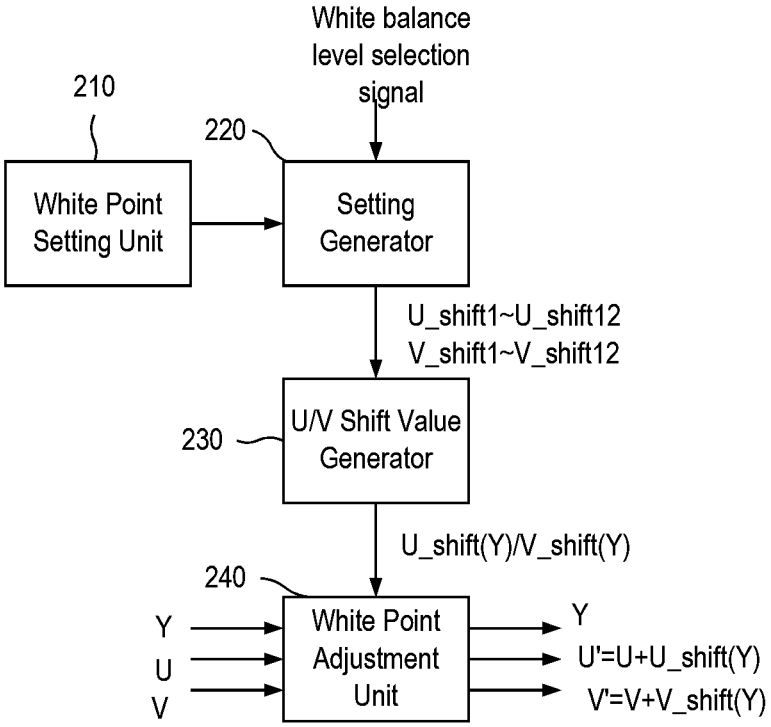
FIG. 2 is a block diagram of a white balance adjustment unit according to the present invention.

FIG. 2 is a block diagram of the white balance adjustment unit 120 according to the present invention. The white balance adjustment unit 120 includes a white point setting unit 210, a setting generator 220, a U/V shift value generator 230, and a white point adjustment unit 240.

The white point setting unit 210 has a plurality of first chrominance shift signals U_shift and a plurality of second chrominance shift signals V_shift.

Figure 3:
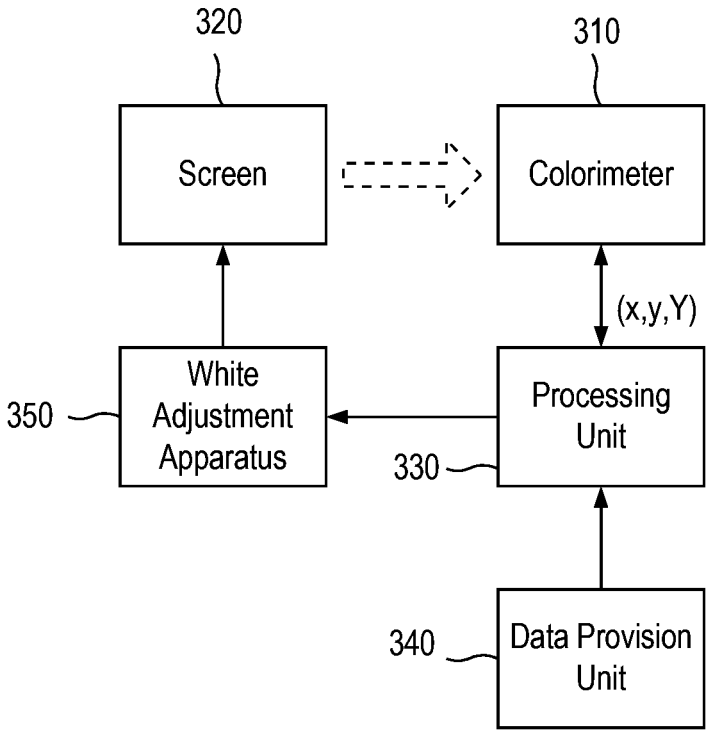
FIG. 3 schematically illustrates how a plurality of first chrominance shift signals and a plurality of second chrominance shift signals are generated according to the present invention.

FIG. 3 schematically illustrates how the plurality of first chrominance shift signals U_shift and the plurality of second chrominance shift signals V_shift are generated according to the present invention. As shown, a colorimeter 310 is used to perform a color analysis on a screen 320. The colorimeter 310 is used to assist the screen 320 in white balance adjustment. The colorimeter 310 has a measuring probe (not shown) for measuring the ray radiated from the screen 320 and outputs signals (x, y, Y), where x and y denote the color coordinate of a color domain, and Y denotes a brightness value.

More specifically, the measuring probe of the colorimeter 310 is located approximately 20 cm from the LCD panel of the screen 320 to measure the ray radiated from the panel and to carry out a fine adjustment. A measurement can be represented as x, y (color coordinates), and Y (brightness value). Alternatively, a measurement can be represented as T (correlated to color temperature), Δuv (color difference to a black body locus), and Y (brightness value).

Standard color data for the desired color temperatures can be pre-stored in the colorimeter 310. In one example, if the color temperature is at 9300K, the color coordinate and brightness are x=0.296, y=0.311, and Y=135 cd/m$^2$. In another example, if the color temperature is at 6500K, the color coordinate and brightness are x=0.313, y=0.329, and Y=135 cd/m$^2$.

A processing unit 330 is connected to the colorimeter 310 for receiving an output of the colorimeter 310 and searching for a first chrominance shift signal U_shift and a second chrominance shift signal V_shift at a brightness node (Y node) optimally matched with the brightness value of the output of the colorimeter 310.

A data provision unit 340 is connected to the processing unit 330 for providing a white balance target color coordinate. The processing unit 330 searches for the first chrominance shift signal U_shift and the second chrominance shift signal V_shift at the Y node optimally matched with the brightness value of the output of the colorimeter 310 based on the output of the colorimeter 310 and the white balance target color coordinate provided by the data provision unit 340. When the processing unit 330 obtains the first chrominance shift signal U_shift and the second chrominance shift signal V_shift at the Y node, it searches for another first chrominance shift signal U_shift and another second chrominance shift signal V_shift at a next Y node optimally matched with the brightness value of the next output of the colorimeter 310.

When searching at the next Y node, the processing unit 330 configures a white color adjustment apparatus 350 based on the white balance target color coordinate provided by the data provision unit 340 to allow the white color adjustment apparatus 350 to drive the screen to display a white frame at the next Y node.

After repeating the aforesaid procedure several times, a set of white point settings including a plurality of first chrominance shift signals (U_shift) and a plurality of second chrominance shift signals (V_shift) is obtained. In a preferred embodiment, the procedure is repeated twelve times to generate a plurality of first chrominance shift signals (U_shift) and a plurality of second chrominance shift signals (V_shift) at twelve corresponding Y nodes.

The setting generator 220 is connected to the white point setting unit 210 to receive multiple sets of white point settings. Each set of white point settings contains the plurality of first chrominance shift signals (U_shift) and the plurality of second chrominance shift signals (V_shift). The setting generator 220 also receives a white balance level selection signal. Based on the sets of white point settings and the white balance level selection signal, the setting generator 220 generates N first chrominance shift interpolation signals (U_shift_1 to U_shift_12) and N second chrominance shift interpolation signals (V_shift_1 to V_shift_12), where N is a positive integer representative of the number of nodes.

The setting generator 220 employs an interpolation method to generate the N first chrominance shift interpolation signals (U_shift_1 to U_shift_12) and the N second chrominance shift interpolation signals (V_shift_1 to V_shift_12) corresponding to specific white balance levels.

The color temperatures between 4500K and 8500K are divided into 256 parts. The color temperatures associated with the plurality of first and second chrominance shift signals (U_shift) and (V_shift) corresponding respectively to twelve Y nodes are used as references for the interpolation. For example, there is a set (U_shift45, V_shift45) applied in the interpolation when the color temperature is at 4500K. There is also a set (U_shift65, V_shift65) applied in the interpolation when the color temperature is at 6500K. There is also a set (U_shift85, V_shift85) applied in the interpolation when the color temperature is at 8500K. Accordingly, when a color temperature of 5500K is desired, the first chrominance shift interpolation signals (U_shift_1 to U_shift_12) and the second chrominance shift interpolation signals (V_shift_1 to V_shift_12) can be obtained by applying the two sets (U_shift45, V_shift45) and (U_shift65, V_shift65) in the interpolation.

The U/V shift value generator 230 is connected to the setting generator 220 for receiving the N first chrominance shift interpolation signals (U_shift_1 to U_shift_12) and the N second chrominance shift interpolation signals (V_shift_1 to V_shift_12) to generate a first chrominance offset U_shift (Y) and a second chrominance offset V_shift(Y).

The U/V shift value generator 230 also employs the interpolation method to generate the first chrominance offset U_shift(Y) and the second chrominance offset V_shift(Y). The U/V shift value generator 230 performs the interpolation based on a luminance signal Y.

The white point adjustment unit 240 is connected to the RGB to YUV conversion unit 110 and the U/V shift value generator 230 to receive the first YUV image signal, the first chrominance offset U_shift(Y), and the second chrominance offset V_shift(Y). The white point adjustment unit 240 then adjusts the first YUV image signal based on the first chrominance offset U_shift(Y) and the second chrominance offset V_shift(Y). The white point adjustment unit 240 next generates the second YUV image signal.

More specifically, the white point adjustment unit 240 adds the first chrominance offset U_shift(Y) to the first chrominance signal U of the first YUV image signal, and adds the second chrominance offset V_shift(Y) to the second chrominance signal V of the first YUV image signal.

Figure 4:
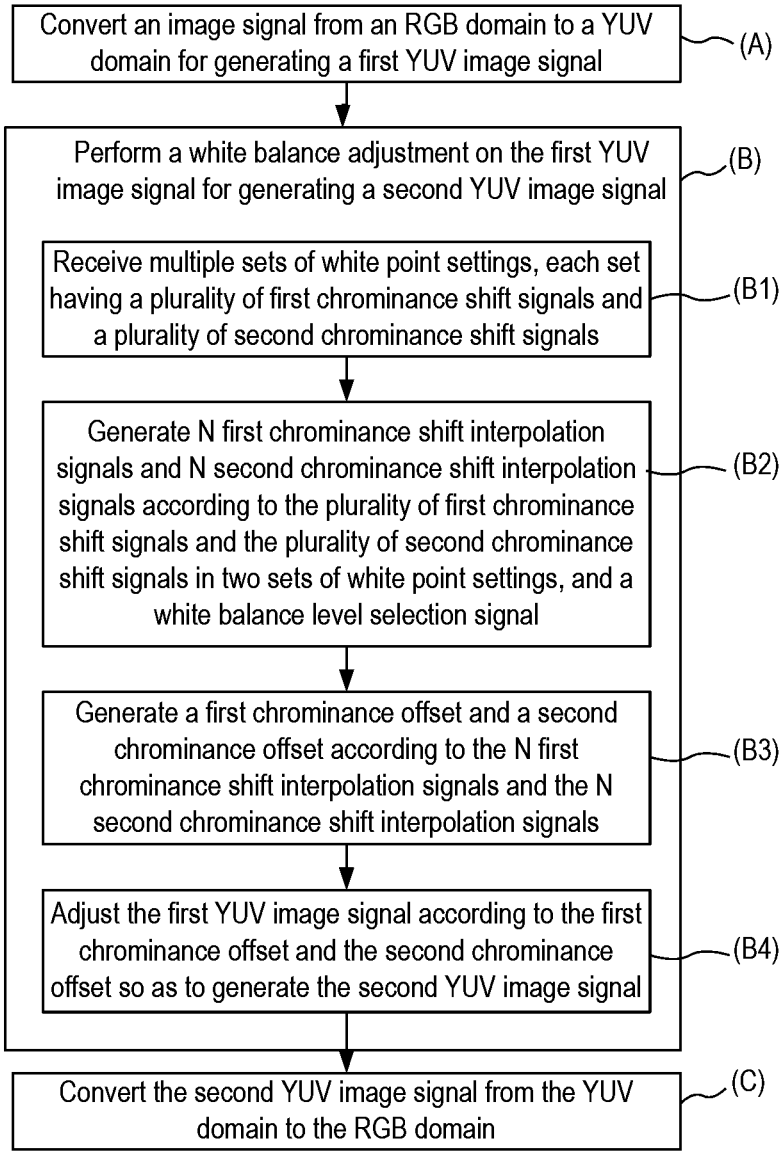
FIG. 4 is a flowchart of an optimization method of real-time LCD white balance selection according to the present invention.

FIG. 4 is a flowchart of an optimization method of real-time LCD white balance selection according to the present invention, which is used in an image display device including the system shown in FIG. 1. As shown in FIGS. 1 to 4, in step (A) of the optimization method, an image signal is converted from a predetermined domain (i.e. an RGB domain) to a YUV domain to generate a first YUV image signal. In Step (B) of the optimization method, a white balance adjustment is performed on the first YUV image signal to generate a second YUV image signal.

Step (B) of the optimization method can be further divided into steps (B1)-(B4).

In step (B1), multiple sets of white point settings are received. Each set of white point settings has a plurality of first chrominance shift signals U_shift and a plurality of second chrominance shift signals V_shift.

In step (B2), the plurality of first chrominance shift signals U_shift and the plurality of second chrominance shift signals V_shift in two sets of white point settings as well as a white balance level selection signal are used to generate N first chrominance shift interpolation signals (U_shift_1 to U_shift_12) and N second chrominance shift interpolation signals (V_shift_1 to V_shift_12) by interpolation.

In step (B3), a first chrominance offset U_shift(Y) and a second chrominance offset V_shift(Y) are generated by interpolation based on the N first chrominance shift interpolation signals (U_shift_1 to U_shift_12) and the N second chrominance shift interpolation signals (V_shift_1 to V_shift_12), respectively.

In step (B4), the first chrominance offset U_shift(Y) and the second chrominance offset V_shift(Y) are used to adjust the first YUV image signal. More specifically, the first chrominance offset U_shift(Y) is added to the first chrominance signal U of the first YUV image signal and the second chrominance offset V_shift(Y) is added to the second chrominance signal V of the first YUV image signal. The second YUV image signal is then generated.

In step (C) of the optimization method, the second YUV image signal is converted from the YUV domain to the predetermined domain, such as an RGB domain.

Figure 5:
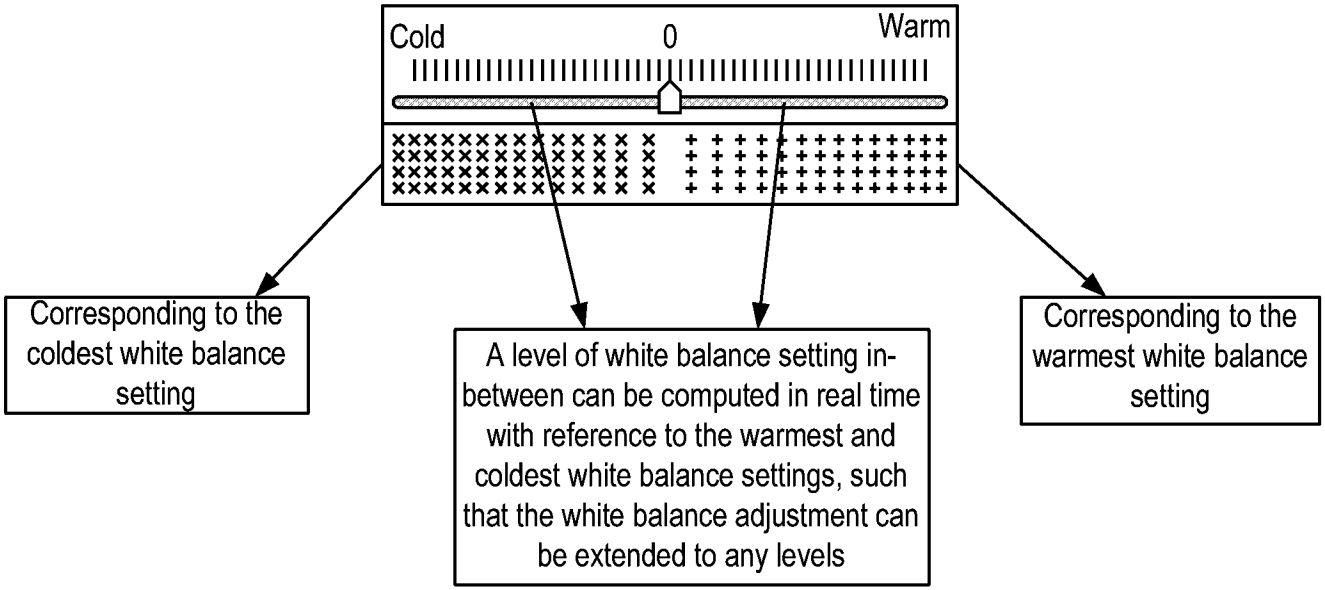
FIG. 5 schematically illustrates a user-interface of a mobile app coded with an optimization method of real-time LCD white balance selection according to the present invention.

The above-mentioned optimization method of real-time LCD white balance selection can be coded by a programming language into a mobile App used in cellphones or other portable devices. Hence, such cellphones or portable devices can have the real-time white balance adjustment function. FIG. 5 schematically illustrates a user-interface (UI) of a mobile App coded with an optimization method of real-time LCD white balance selection according to the present invention. As shown in FIG. 5, a scrolling bar is provided to a user to select a desired white balance level. The 'Cold' label indicates the coldest color for the white balance setting. The 'Warm' label indicates the warmest color for white balance setting. A level of white balance setting between 'Cold' and 'Warm' can be computed in real-time with references to the coldest and warmest white balance settings. As a result, the white balance adjustment can be extended to any levels.

The minimum number of the Y nodes is twelve to ensure the accuracy of the white balance adjustment. The accuracy of the white balance adjustment of individual gray scales increases as the number of the Y nodes increases.

In view of the foregoing descriptions, it should be clear that the concept of the white balance adjustment of the present invention is fundamentally different from that of the prior art. The white balance adjustment of the present invention is simplified as the white balance adjustment is performed in the YUV domain, where only the U/V signal is adjusted while the Y signal is unchanged. Accordingly, the luminance of most gray scales is maintained with no loss during a white point coordinate adjustment. Moreover, the white balance adjustment of present invention can also combine with an automatic measurement system to speed up the adjustment. With real-time computation, real-time white balance setting adjustment between the coldest and warmest color temperatures can occur immediately.

Although the present invention has been explained in relation to its preferred embodiments, it is to be understood that many other possible modifications and variations can be made without departing from the spirit and scope of the invention as hereinafter claimed.

What is claimed is:

1. An optimization system of real-time LCD white balance selection, comprising:

an RGB to YUV conversion unit for receiving an image signal and converting the image signal from an RGB domain to a YUV domain to generate a first YUV image signal;

a white balance adjustment unit connected to the RGB to YUV conversion unit for performing a white balance adjustment on the first YUV image signal to generate a second YUV image signal, wherein the white balance adjustment unit includes:

a white point setting unit for storing multiple sets of white point settings, each set having a plurality of first chrominance shift signals and a plurality of second chrominance shift signals;

a setting generator connected to the white point setting unit for receiving the plurality of first chrominance shift signals and the plurality of second chrominance shift signals in the multiple sets of white point settings, and a white balance level selection signal for generating respective N first chrominance shift interpolation signals and N second chrominance shift interpolation signals, where N is a positive integer;

a U/V shift value generator connected to the setting generator for receiving the N first chrominance shift interpolation signals and the N second chrominance shift interpolation signals to generate a first chrominance offset and a second chrominance offset; and a white point adjustment unit connected to the U/V shift value generator and the RGB to YUV conversion unit for adjusting the first YUV image signal based on the first chrominance offset and the second chrominance offset to generate the second YUV image signal; and a YUV to RGB conversion unit for converting the second YUV image signal from the YUV domain to the RGB domain, wherein the U/V shift value generator generates the first chrominance offset and the second chrominance offset by interpolation.

2. The optimization system of real-time LCD white balance selection as claimed in claim 1, wherein the setting generator generates the N first chrominance shift interpolation signals and the N second chrominance shift interpolation signals by interpolation.

3. The optimization system of real-time LCD white balance selection as claimed in claim 1, wherein the white point adjustment unit adds the first chrominance offset to a first chrominance signal of the first YUV image signal, and adds the second chrominance offset to a second chrominance signal of the first YUV image signal.

4. An optimization method of real-time LCD white balance selection applied in an image display device, the optimization method comprising the steps of:

(A) converting an image signal from an RGB domain to a YUV domain for generating a first YUV image signal;

(B) performing a white balance adjustment on the first YUV image signal for generating a second YUV image signal, which further includes the steps of:

(B1) receiving multiple sets of white point settings, each set having a plurality of first chrominance shift signals and a plurality of second chrominance shift signals;

(B2) generating N first chrominance shift interpolation signals and N second chrominance shift interpolation signals according to the plurality of first chrominance shift signals and the plurality of second chrominance shift signals in two sets of white point settings, and a white balance level selection signal, where N is a positive integer;

(B3) generating a first chrominance offset and a second chrominance offset according to the N first chrominance shift interpolation signals and the N second chrominance shift interpolation signals; and (B4) adjusting the first YUV image signal according to the first chrominance offset and the second chrominance offset to generate the second YUV image signal; and (C) converting the second YUV image signal from the YUV domain to the RGB domain, wherein in step (B3), the first chrominance offset and the second chrominance offset are generated by interpolation.

5. The optimization method of real-time LCD white balance selection as claimed in claim 4, wherein in step (B2), the N first chrominance shift interpolation signals and the N second chrominance shift interpolation signals are generated by interpolation.

6. The optimization method of real-time LCD white balance selection as claimed in claim 4, wherein step (B4) performs an addition of the first chrominance offset and a first chrominance signal of the first YUV image signal and an addition of the second chrominance offset and a second chrominance signal of the first YUV image signal.

* * * * *